US007841488B2

(12) United States Patent
Hagihara et al.

(10) Patent No.: US 7,841,488 B2
(45) Date of Patent: Nov. 30, 2010

(54) SHEET-LIKE ARTICLE STORAGE CONTAINER

(75) Inventors: Yoshihiro Hagihara, Higashi-Osaka (JP); Yuriko Matsumoto, Ibaraki (JP); Yumiko Takeda, Ibaraki (JP); Yoshinobu Saito, Ibaraki (JP); Tetsuo Nishina, Ibaraki (JP)

(73) Assignee: Shiseido Honeycake Co., Ltd., Osaka (JP)

( * ) Notice: Subject to any disclaimer, the term of this patent is extended or adjusted under 35 U.S.C. 154(b) by 302 days.

(21) Appl. No.: 11/814,328

(22) PCT Filed: Jun. 6, 2005

(86) PCT No.: PCT/JP2005/010366

§ 371 (c)(1),
(2), (4) Date: Jul. 19, 2007

(87) PCT Pub. No.: WO2006/085395

PCT Pub. Date: Aug. 17, 2006

(65) Prior Publication Data

US 2008/0121544 A1 May 29, 2008

(30) Foreign Application Priority Data

Feb. 8, 2005 (JP) ..... 2005-031692

(51) Int. Cl.
*B65D 85/62* (2006.01)

(52) U.S. Cl. ..... 221/45; 221/33; 221/36; 221/246

(58) Field of Classification Search ..... 221/33, 221/36, 37, 40, 41, 45, 51, 56–58, 61–63, 221/208, 210, 220, 244, 246, 279, 311
See application file for complete search history.

(56) References Cited

U.S. PATENT DOCUMENTS

| | | | | |
|---|---|---|---|---|
| 930,619 | A * | 8/1909 | Russell | 221/36 |
| 1,296,484 | A * | 3/1919 | Cutler | 206/39 |
| 1,370,560 | A * | 3/1921 | Russell | 221/260 |
| 1,378,294 | A * | 5/1921 | Stevenson | 221/246 |

(Continued)

FOREIGN PATENT DOCUMENTS

JP 04-6316 Y1 6/1929

(Continued)

*Primary Examiner*—Gene Crawford
*Assistant Examiner*—Kelvin L Randall, Jr.
(74) *Attorney, Agent, or Firm*—Birch, Stewart, Kolasch & Birch, LLP

(57) ABSTRACT

A sheet member container from which sheet members housed in a stacked state can be taken out reliably and in which occurrence of a wrinkle in a next sheet member in a returning operation of a sheet feeder is reduced. The sheet member container includes a container body having a top face opening for containing stacked sheet members; a lid member for openably/closably closing with respect to a top face opening of the container body; and a sheet feeding mechanism provided for the lid member for feeding the sheet members one by one from the top via a slot formed in either one of the container body or the lid member. The sheet member container includes a mechanism for bending the sheet members housed in the container body in a direction orthogonal to a feeding direction of the sheet members.

8 Claims, 5 Drawing Sheets

U.S. PATENT DOCUMENTS

| | | | | | |
|---|---|---|---|---|---|
| 1,701,709 | A | * | 2/1929 | Ostrander | 221/41 |
| 2,557,323 | A | * | 6/1951 | Testi | 221/33 |
| 2,732,935 | A | * | 1/1956 | Gui | 206/449 |
| 2,769,569 | A | * | 11/1956 | Sinclair | 221/37 |
| 3,300,085 | A | * | 1/1967 | Simor | 221/41 |
| 3,892,309 | A | * | 7/1975 | Coffey et al. | 206/449 |
| 4,166,551 | A | * | 9/1979 | Stiros | 221/51 |
| 4,349,186 | A | * | 9/1982 | Nakamura | 271/18 |
| 4,401,233 | A | * | 8/1983 | Frey | 221/36 |
| 4,638,908 | A | * | 1/1987 | Baitz et al. | 206/0.8 |
| 4,772,168 | A | * | 9/1988 | Ackeret | 414/792.7 |
| 4,784,556 | A | * | 11/1988 | Ackeret | 414/788.8 |
| D392,157 | S | * | 3/1998 | Shibuya | D7/629 |
| 6,105,858 | A | * | 8/2000 | Chien | 232/1 D |
| 6,213,300 | B1 | * | 4/2001 | Flaig et al. | 206/494 |
| 7,287,666 | B2 | * | 10/2007 | De Laforcade | 221/65 |
| 7,431,286 | B2 | * | 10/2008 | Powell et al. | 271/148 |
| 2009/0302048 | A1 | * | 12/2009 | Nobilet et al. | 221/1 |

FOREIGN PATENT DOCUMENTS

| | | | | |
|---|---|---|---|---|
| JP | 55-113118 | | | 8/1980 |
| JP | 56-38073 | U | | 4/1981 |
| JP | 2004-315236 | A | | 11/2004 |
| WO | WO-2004/024593 | A | | 3/2004 |
| WO | WO 2004024593 | A1 | * | 3/2004 |

* cited by examiner

SHEET-LIKE ARTICLE STORAGE CONTAINER

TECHNICAL FIELD

The present invention relates to sheet member containers in which sheet members such as paper soap and oil blotting papers are contained in a stacked state and from which the sheet members can be fed to be taken out one by one.

BACKGROUND ART

There is a known conventional sheet member container of this kind including a container body in which sheet members are housed so as to be stacked in a horizontal state, a lid member with which a top face opening of the container body is opened/closed, a feeding movable body provided for the lid member for feeding the sheet members, and a pressing member attached to the movable body for pressing the sheet members (see, for example, Patent Literature 1).

By moving the feeding movable body, the sheet members are fed one by one, and the top sheet member against which the pressing member presses is taken out.

Patent Literature 1: Japanese Utility Model Application Laid-Open Publication No. SH055-113118 (pp. 1 to 5, FIGS. 1 to 4)

DISCLOSURE OF THE INVENTION

Problem To Be Solved By The Invention

However, in the previously described conventional sheet member container, since the sheet members housed in the container body are stacked in a horizontal state, when the movable body is returned after the sheet member is taken out, the pressing member applies frictional force to the next top sheet member in the container. Unfortunately, the sheet member slides and is compressed between the pressing member and a back wall of the container body, so that a wrinkle (buckling) occurs.

In view of the above described problem, an object of the present invention is to provide a sheet member container from which sheet members housed in a stacked state can be taken out reliably and in which occurrence of a wrinkle in the next sheet member at the time of returning operation of sheet feeding means can be reduced.

Means for Solving the Problem

To solve the above described problem, a sheet member container of the present invention comprises: a container body having a top face opening for containing stacked sheet members; a lid member for openably/closably closing with respect to the top face opening of the container body; and sheet feeding means provided for the lid member for feeding the sheet members one by one from the top via a slot formed in either one of the container body or the lid member, wherein bending means for bending the sheet members housed in the container body in a direction orthogonal to a feeding direction of the sheet members is provided.

Accordingly, by making the sheet members housed in the container body bend in the direction orthogonal to the feeding direction of the sheet members, rigidity can be given to the stacked sheet members. Therefore, the sheet members can be smoothly moved in the feeding direction and taken out, at the time of returning operation of the sheet feeding means, occurrence of a wrinkle in the next sheet member can be reduced.

The bending means may be a curved portion formed in a bottom face of the container body to curve the sheet members so that a middle in the direction orthogonal to the feeding direction of the sheet members may project downward.

With such configuration, only by housing the stacked sheet members in the container body, the housed sheet members easily curve along the shape of the curved portion so that rigidity can be given in a reasonable state.

In the container body, a front wall near the slot has an inclined face for lifting up a tip of the fed sheet member, and an upper edge of the slot is positioned more to a housing side than the tip of the sheet member that is fed to reach a lower edge of the slot and be about to stick out.

Therefore, by the inclined face of the front wall near the slot, the tip of the fed sheet member is lifted up and the sheet member moves obliquely upward. The sheet member that is fed to reach the lower edge of the slot by further movement and stick out. Since the upper edge of the slot is positioned more to the housing side than the tip of the sheet member that is fed to be about to stick out, the tip of the fed sheet member can be smoothly led to the outside without disturbing travel of the fed sheet member. Thus, the whole sheet member can be taken out smoothly.

The sheet feeding means comprises: a feeding movable body having an attachment part inserted in a guide hole formed in the lid member and being slid in the sheet feeding direction by an operation from the outside of the lid member; and a pressing member, a base end of the pressing member is upwardly inserted in the attachment part of the movable body and a portion from a middle to an end of the pressing member is pressed against the top face of the sheet member.

In this case, since a long portion from the middle to the end of the pressing member is in contact with the top face of the sheet member, force in the feeding direction accompanying a sliding operation of the feeding movable body is sufficiently applied to the sheet member and the sheet member can be smoothly fed.

EFFECT OF THE INVENTION

According to the present invention, by making sheet members housed in a container body bend in a direction orthogonal to a feeding direction of the sheet members, rigidity can be given to the sheet members themselves. Thus, at the time of returning operation of sheet feeding means, occurrence of a wrinkle in the next sheet member can be reduced.

DESCRIPTION OF REFERENCE NUMERALS

Figure 1:
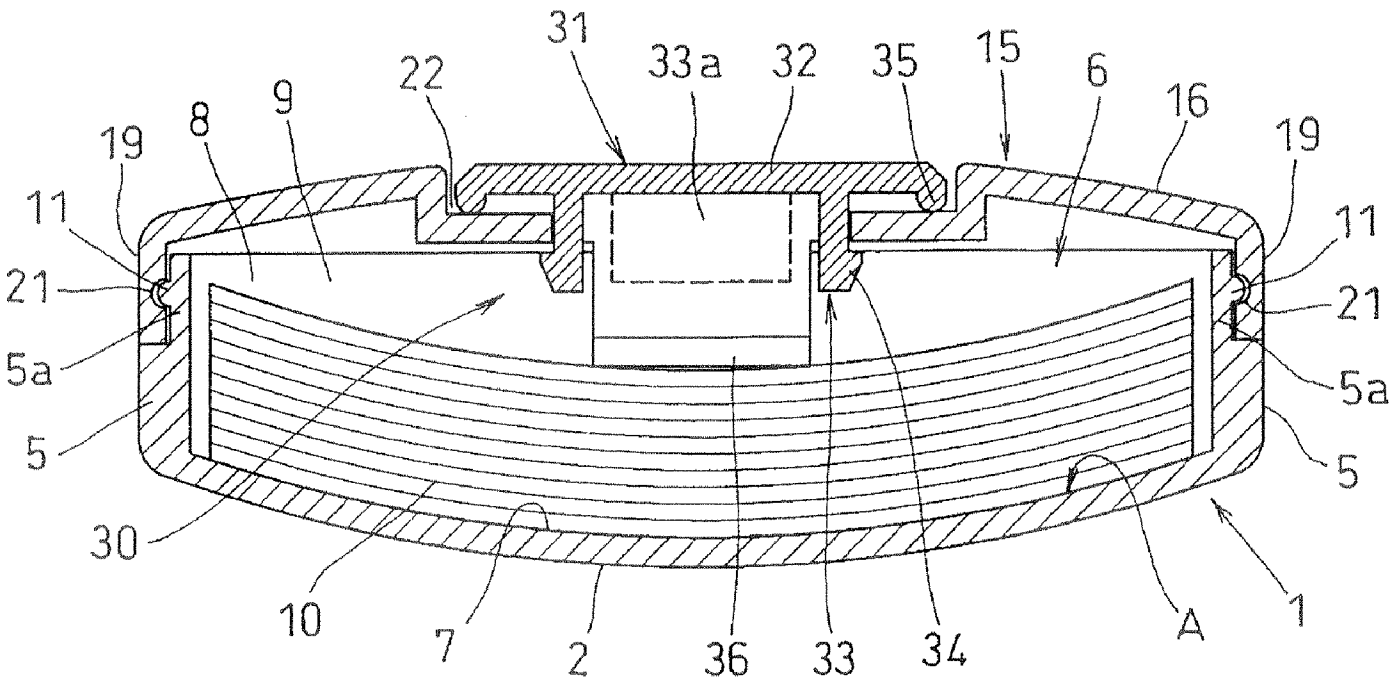
FIG. 1 is a longitudinal front view of a sheet member container in one embodiment of the present invention.
Figure 2:
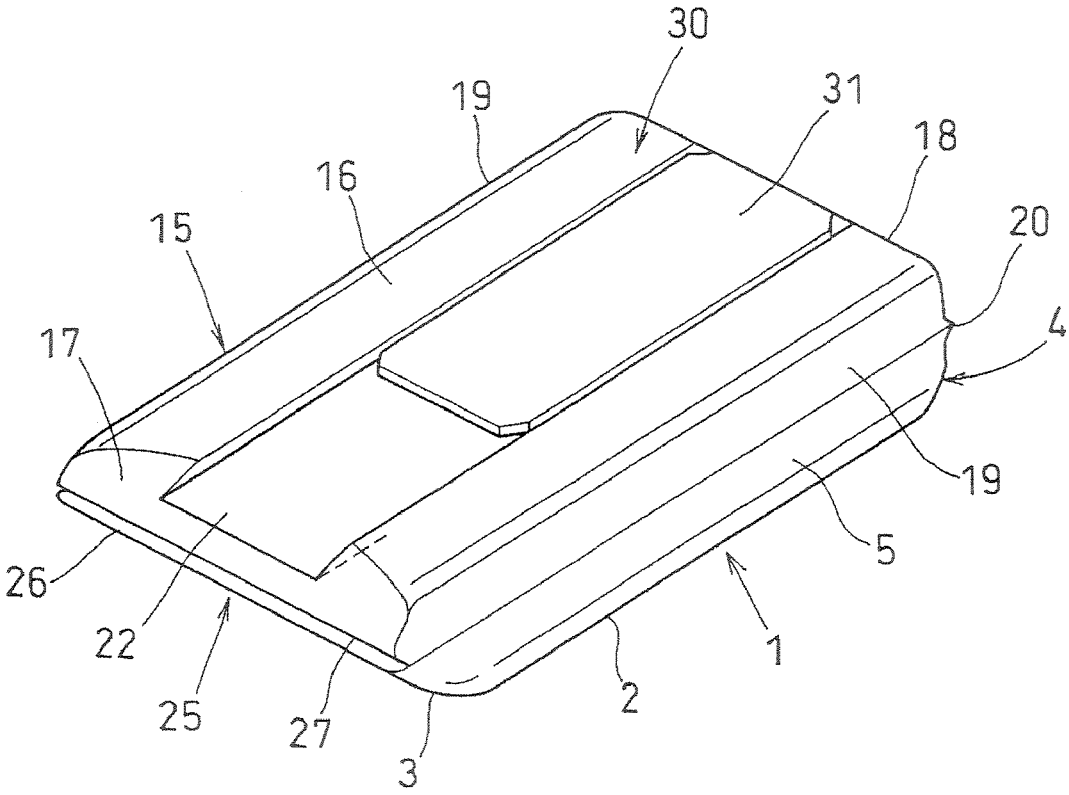
FIG. 2 is a perspective view of the sheet member container.
Figure 3:
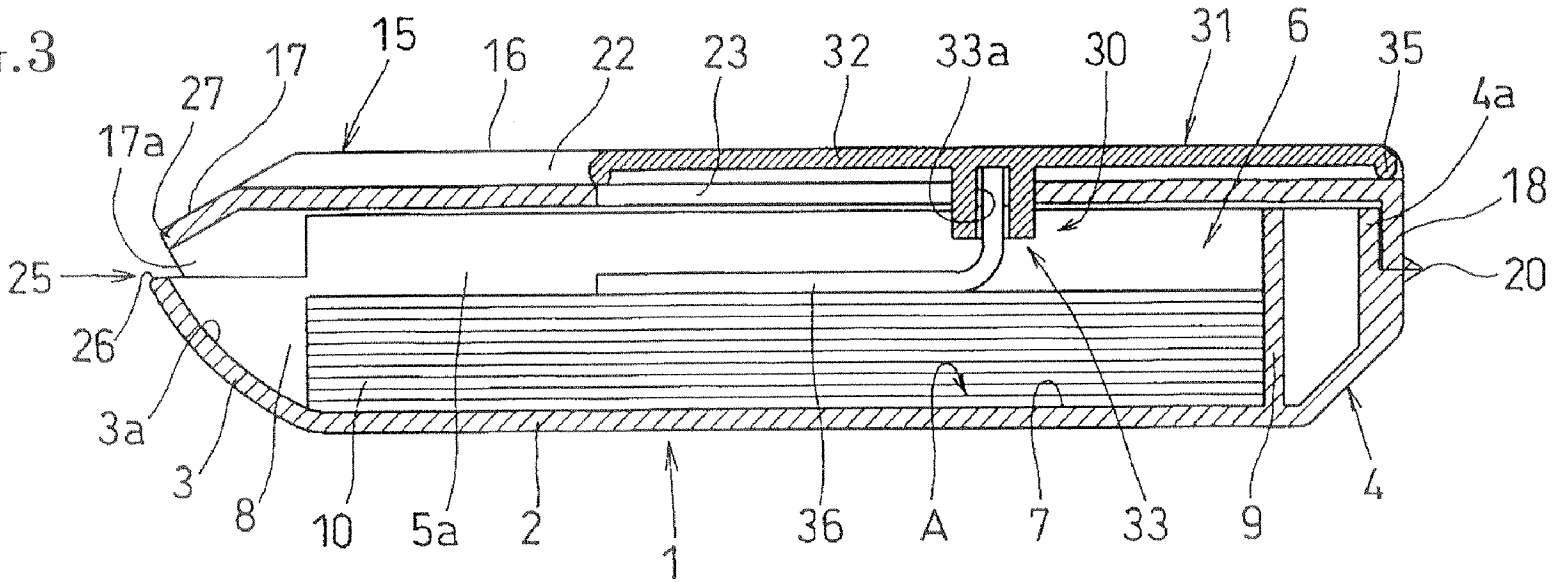
FIG. 3 is a longitudinal side view of the sheet member container.
Figure 4:
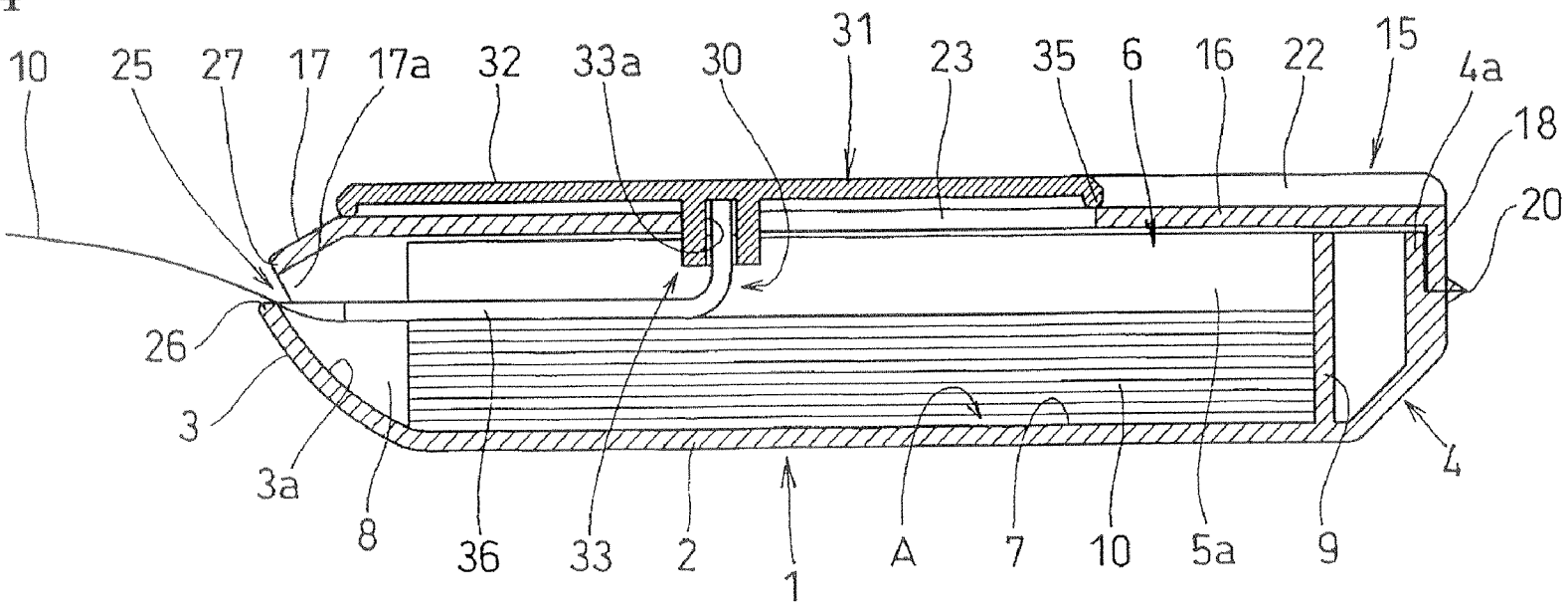
FIG. 4 is a longitudinal side view showing a state in which a sheet member is taken out from the sheet member container.

1 container body
2 bottom face

6 top face opening
7 curved portion (circular face)
9 positioning guide
10 sheet member
15 lid member
23 guide hole
25 slot
26 lower edge
27 upper edge
30 sheet feeding means
31 feeding movable body
32 operation part
33 attachment part
34 retaining part
36 pressing member
A bending means

BEST MODE FOR CARRYING OUT THE INVENTION

A sheet member container of the present invention is provided with bending means for bending sheet members housed in a container body in a direction orthogonal to a feeding direction of the sheet members to give rigidity to the sheet member itself, thereby reducing occurrence of a wrinkle in the next sheet member at the time of returning operation of sheet feeding means.

Embodiment 1

A best mode for carrying out the present invention will be described with reference to FIGS. 1 to 6. As shown in FIGS. 1 to 4, a sheet member container of the present invention comprises a container body 1 in which stacked sheet members 10 are housed, a lid member 15 with which the container body 1 is covered, a slot 25 defined by the container body and the lid member 15 for taking out the sheet members 10, and sheet feeding means 30 provided for the lid member 15.

In the drawings, a feeding side of the sheet member 10 in the container body 1 corresponds to a front side, a side opposite to the feeding side corresponds to a rear side, and a width direction orthogonal to a feeding direction of the sheet member 10 corresponds to a lateral direction.

The drawings illustrate the case where, for example, paper soap having a rectangular shape in plan view is used as the sheet members 10.

The container body 1 has a portable size and is obtained by integrally forming a bottom face 2 having a rectangular shape in plan view, a front wall 3 extended from a front end of the bottom face 2, a rear wall 4 extended from a rear end of the bottom face 2, and right and left side walls 5 extended upright from sides of the bottom face 2.

The front wall 3, rear wall 4, and right and left side walls 5 have almost the same height, and a top face opening 6 having an almost rectangular shape in plan view is defined by the front wall 3, rear wall 4, and right and left walls 5.

In the bottom face 2, a curved portion (circular face) 7 as bending means A is formed in the width direction. As shown in FIG. 1, the curved portion 7 has a gentle curved face which is curved so as to be gradually lowered toward a middle from both ends in a front section taken along the width direction. The curved portion 7 serves as a housing portion 8 for housing the stacked sheet members 10.

When the stacked sheet members 10 are mounted in the housing portion 8, the sheet members 10 are curved along the curved portion 7 of the bottom face 2 so that the sheet members 10 may gradually lower toward a middle of the curved portion 7 and both edges of the sheet members 10 slightly rise. With such configuration, the sheet members 10 have rigidity in the feeding direction.

In the front wall 3, a circular inclined face (moving guide portion) 3*a* whose front side rises toward a lower edge 26 of the slot 25 which will be described later is formed in front of the housing position of the lower sheet members 10. Along the inclined face 3*a*, a tip of the fed sheet member 10 rises upward and moves obliquely upward.

A rectangular-shaped positioning guide 9 is provided upright in the width direction in front of the rear wall 4 at a rear end of the housing portion 8. By the positioning guide 9, a rear end position of the sheet members 10 is set, and the stacked sheet members 10 are housed in an aligned state.

Near an upper end of the rear wall 4, a thin engagement wall 4*a* upright from an inside portion is formed. An inner face of a rear wall 18 of the lid member 15 which will be described later is detachably in contact with a step formed between a rear end face of the rear wall 4 and an outer face of the engagement wall 4*a*.

A thin engagement wall 5*a* upright from an inside portion of an upper end of the right and left side walls 5 is formed and is continued to the engagement wall 4*a* of the rear wall 4. An inner face of a side wall 19 of the lid member 15 which will be described later is detachably in contact with a step formed between an end face of the right and left side walls 5 and an outer face of the engagement wall 5*a*. A retaining projection 11 which engages with a retaining recess 21 in the lid member 15 which will be described is formed in the engagement wall 5*a*.

The lid member 15 is obtained by integrally forming a top face 16 having a rectangular shape in plan view, a front wall 17 extended from the front end of the top face 16 and having an almost semilunar shape in plan view, a rear wall 18 extended downward from the rear end of the top face 16, and the right and left side walls 19 extended downward from both sides of the top face 16.

The rear wall 18 of the lid member 15 and the rear wall 4 of the bottom face 2 of the container body 1 are integrally formed by being coupled to each other via a hinge 20. The container body 1 can be opened or closed with the lid member 15 via the hinge 20.

A retaining recess 21 is formed on an inside of both of the side walls 19 of the lid member 15. By making the lid member 15 engage with the engagement walls 4*a* and 5*a*, a top face of a peripheral wall of the container body 1 and a bottom face of a peripheral wall of the lid member 15 are brought into contact with each other. The retaining projection 11 of the container body 1 is fit in the retaining recess 21 so that a state where the container body 1 is closed with the lid member 15 can be maintained.

In the closed state, the end face of an opening 17*a* of the lid member 15 is positioned to an upper part of the inner face near the opening of the front wall 3 of the container body 1.

A recess 22 is formed along a longitudinal direction in a middle in the width direction of the top face 16 of the lid member 15, and a guide hole 23 in the sheet feeding means 30 which will be described later is formed to be a rectangular shape in plan view in an almost middle in the longitudinal direction of the recess 22.

The front wall 17 of the lid member 15 is leaned forward and downward from the top face 16. By forming a gap between the lower end of the front wall 17 and the top face of the front wall 3 of the container body 1, the slot 25 is formed.

The top face of the front wall 3 of the container body 1 is the lower edge 26 of the slot 25, and a lower end opening periphery of the front wall 17 of the lid member 15 is an upper edge 27 of the slot 25. In side view, an opening face of the upper edge 27 of the slot 25 is inclined obliquely upward from an inner side, the opening face of the lower edge 26 faces upward, and the lower edge 26 and the upper edge 27 of the slot 25 show a V shape which opens to an outside.

The upper edge 27 of the slot 25 is not positioned on the extension line of the inclined face 3*a* which is inclined upward and outward of the inner face of the front wall 3 of the container body 1. At the time of feeding the sheet member 10, the upper edge 27 of the slot 25 is positioned more to the housing portion 8 than the tip of the sheet member 10 that is fed to reach the lower edge 26 of the slot 25 and be about to stick out.

Consequently, even lower sheet members 10 can be also taken out of the slot 25 without being disturbed by the front wall 17 of the lid member 15.

The sheet feeding means 30 has a feeding movable body 31 provided for the lid member 15 to be slidably operable, and a pressing member 36 attached to the movable body 31.

The movable body 31 has an operation part 32 having a rectangular shape in plan view and positioned in the recess 22 of the lid member 15, an attachment part 33 projected from a middle of the under face of the operation part 32, retaining parts 34 provided on both sides of the attachment part 33, and an angular and annular shaped contact part 35 formed at the periphery of the under face of the operation part 32.

The contact part 35 of the movable body 31 comes into contact with the top face of the recess 22 in the lid member 15, the attachment part 33 is inserted in the guide hole 23, and the retaining parts 34 on both sides are retained by the periphery of the guide hole 23, thereby preventing the movable body 31 from detaching from the lid member 15. The movable body 31 is slidably operable in the sheet feeding direction within the range that the attachment part 33 moves to the front and rear directions in the guide 22.

The attachment part 33 has an insertion hole 33*a* which opens downward and to which the base end of the pressing member 36 is inserted upward from below.

The pressing member 36 is made of silicon rubber having elasticity, base end of the pressing member 36 is attached to the attachment part 33, and portion from a middle to a tip of the pressing member 36 is in contact with the sheet member 10.

A mode of use will now be described with reference to FIGS. 1 to 4. The lid member 15 is lifted up, the stacked sheet members 10 are inserted into the container body 1, and the rear end face of the sheet members 10 is positioned by the positioning guide 9. The sheet members 10 housed in the stacked state are curved along the curved portion 7 of the bottom face 2 of the container body 1 so that a middle thereof protrudes downward. By the bending in the direction orthogonal to the direction of taking out, rigidity in the drawing direction is applied to the sheet members 10.

After setting the sheet members 10, when the top face opening 6 of the container body 1 is closed with the lid member 15, the pressing member 36 elastically bents while being in contact with the sheet member 10, and presses against an almost a middle (recessed portion) of the curved sheet member 10.

First, in the case of taking out the top sheet member 10, when the movable body 31 is moved from the rear side to the front side, the top sheet member 10 is moved almost in the horizontal direction to a slot 25 side, and a tip of the sheet member 10 sticks out of the slot 25. In this state, a sticking part of the sheet member 10 is hold to be taken out.

At this time, the sheet member 10 to be taken out is guided along a downward curved shape of the lower sheet members 10, and fed in the curved shape.

After the sheet member 10 is taken out, when the movable body 31 is returned to the rear side, the top sheet member 10 is curved downward as described above. Since rigidity (anti-buckling strength) to a returning direction of the movable body 31 is given, when the rear end of the sheet members 10 is in contact with the positioning guide 9 and rearward movement is regulated, the pressing member 36 slides back thereafter. Therefore, a wrinkle (buckling) does not occur in the top sheet member, and disturbance of an aligned state of the stacked sheet members 10 is avoided.

Next, in the case where the relatively lower sheet members 10 is taken out, by operating the movable body 31, the sheet member 10 moves obliquely upward along the inclined face 3*a* of the front wall 3 of the container body 1 and is led to the lower edge 26 of the slot 25.

At this time, the upper edge 27 of the slot 25 is positioned above the lower edge 26 and is positioned more to the housing portion 8 side of the container body 1. Consequently, the tip of the sheet member 10 moves forward even when it comes into contact with the upper edge 27 of the slot 25, and the upper edge 27 serves as a guide for outward guiding the sheet member 10.

As described above, even when the sheet member 10 is curved to be deformed by the curved portion 7 of the bottom face 2 of the container body 1, the sheet members 10 can be reliably taken out from the top sheet member 10 to the last one.

Figure 5:
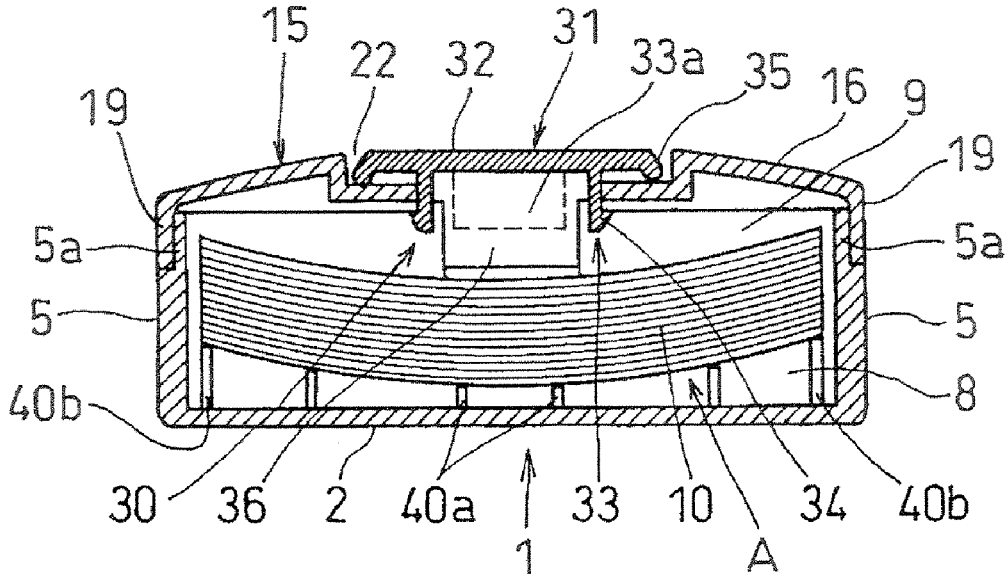
FIG. 5 is a longitudinal front view of a sheet member container in another embodiment of the present invention.

In the above described embodiment, the curved portion 7 is formed as the bending means A in the inner face of the bottom face 2 of the container body 1, whereas a plurality of projections 40*a* and 40*b* having different heights may be provided upright on the inner face of the bottom face 2. For example, as shown in FIG. 5, the projections 40*a* having low height may be provided upright at predetermined intervals in a middle of the bottom face 2, and the projections 40*b* having high height may be provided upright at predetermined intervals toward both ends of the bottom face 2. With such configuration, the sheet members 10 may be bent in the direction orthogonal to the feeding direction on the inside of the container body 1 to have projecting parts and depressing parts.

On the contrary, the projections 40*a*, 40*b* may be provided upright at predetermined intervals so as to have high height in a middle of the bottom face 2 and lower toward both ends.

Figure 6:
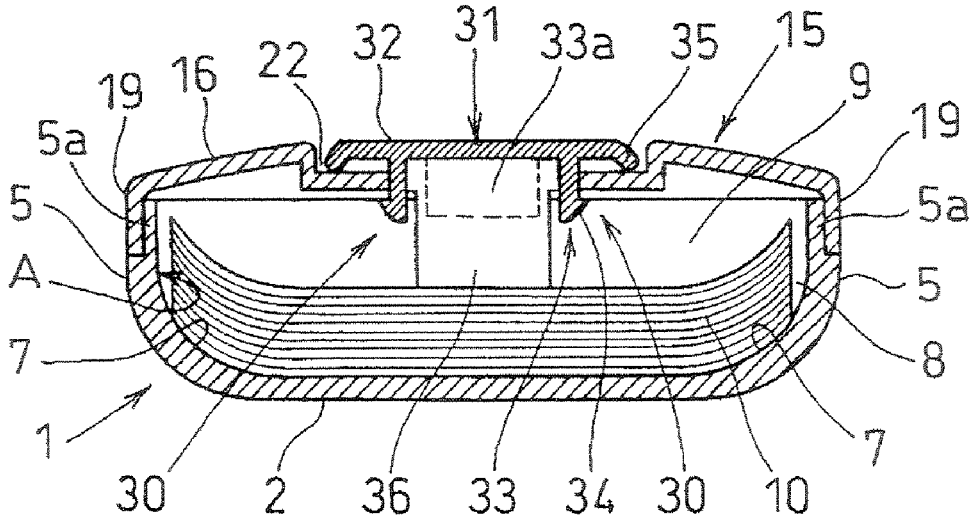
FIG. 6 is a longitudinal front view of a sheet member container in still another embodiment of the present invention.

Further, as shown in FIG. 6, a middle in the width direction of the bottom face 2 may be formed to be flat and the both ends may be formed to be circular, or the middle in the width direction of the bottom face 2 may be formed to be circular and the both ends may be formed to be flat.

Furthermore, not shown, a cushion member having a shape almost the same as that of the sheet members 10 may be laid on the bottom face 2, the sheet members 10 may be stacked on the cushion member, and the sheet member 10 may be pressed so as to bent as described above. In short, the sheet members 10 need only bend in the direction orthogonal to the feeding direction.

The container body 1 and the sheet members 10 may have, for example, circular or ellipse shape in plan view. Two kinds of the sheet members 10 may be housed in the width direction in the container body 1 and taken out of different slots 25. The sheet members 10 which are oil blotting papers may be housed in one of containing parts and the sheet members 10 which are paper soap may be housed in the other containing part.

As the pressing member 36, a spring plate formed by being bent may be used so that the sheet members 10 can be pushed out.

The slot 25 is formed by the gap between a lower edge of the front wall of the lid member 15 and an upper edge of the front wall of the container body 1, whereas a slot 25 having slit shape may be formed only in either one of the front wall of the lid member 15 or the front wall of the container body 1. The container body 1 and the lid member 15 may be separated to open.

INDUSTRIAL APPLICABILITY

A sheet member container of the present invention can be used in the case where sheet members such as paper soap or oil blotting papers are housed in a stacked state and are fed to be taken out one by one.

The invention claimed is:

1. A sheet member container comprising:

a container body having a top face opening for containing stacked sheet members;

a lid member for openably/closably closing with respect to the top face opening of the container body; and a sheet feeding device provided for the lid member for feeding said sheet members one by one from the top via a slot formed in either one of said container body or the lid member, wherein a curved portion is formed in a bottom face of the container body and is configured to bend the sheet members housed in said container body in a direction orthogonal to a feeding direction of the sheet members so that a middle in the direction orthogonal to the feeding direction of the sheet members may project downward, wherein said container body comprises a front wall near the slot and a positioning guide provided upright at a rear end of the bottom face of the container body for aligning rear ends of stacked sheet members said curved portion extending from said front wall to said positioning guide, and wherein said sheet feeding device comprises: a feeding movable body having an attachment part inserted in a guide hole formed in the lid member and being slid in the sheet feeding direction by an operation from an outside of the lid member; and a pressing member, a base end of the pressing member is upwardly inserted in the attachment part of the movable body and a portion from a middle to an end of the pressing member is pressed against a top face of the sheet members.

2. The sheet member container according to claim 1, wherein a front wall near the slot of said container body has an inclined face for lifting up a tip of the fed sheet member, and an upper edge of said slot is positioned more to a housing side than the tip of the sheet member fed to reach a lower edge of the slot.

3. The sheet member container according to claim 1, wherein a top surface of the feeding movable body is flush with a top surface of the lid member.

4. A sheet member container comprising:

a container body having a top face opening for containing stacked sheet members;

a lid member for openably/closably closing with respect to the top face opening of the container body; and a sheet feeding device provided for the lid member for feeding said sheet members one by one from the top via a slot formed in either one of said container body or the lid member, wherein a curved portion is formed in a bottom face of said container body, the curved portion being provided for bending the sheet members housed in said container body in a direction orthogonal to a feeding direction of the sheet members, and a front wall near the slot of said container body has an inclined face for lifting up a tip of the fed sheet member, and an upper edge of said slot is positioned more to a housing side than the tip of the sheet member fed to reach a lower edge of the slot, wherein a positioning guide is provided upright at a rear end of the bottom face of the container body for aligning rear ends of stacked sheet members, said curved portion extending from said front wall to said positioning guide, and wherein said sheet feeding device comprises: a feeding movable body having an attachment part inserted in a guide hole formed in the lid member and being slid in the sheet feeding direction by an operation from an outside of the lid member; and a pressing member, a base end of the pressing member is upwardly inserted in the attachment part of the movable body and a portion from a middle to an end of the pressing member is pressed against a top face of the sheet members.

5. The sheet member container according to claim 4, wherein a top surface of the feeding movable body is flush with a top surface of the lid member.

6. A sheet member container comprising:

a container body having a top face opening for containing stacked sheet members;

a lid member for openably/closably closing with respect to the top face opening of the container body; and a sheet feeding device provided for the lid member for feeding said sheet members one by one from the top via a slot formed in either one of said container body or the lid member, wherein a plurality of projections are formed on an inner face of the container body and are configured to bend the sheet members disposed thereon so that a middle in the direction orthogonal to a feeding direction of the sheet members may project downward, said plurality of projections respectively extending along the feeding direction of the sheet members, wherein said container body comprises a front wall near the slot, a bottom face, and a positioning guide provided upright at a rear end of the bottom face of the container body for aligning rear ends of stacked sheet members, each of said plurality of projections extending from said front wall to said positioning guide, and wherein said sheet feeding means comprises: a feeding movable body having an attachment part inserted in a guide hole formed in the lid member and being slid in the sheet feeding direction by an operation from an outside of the lid member; and a pressing member, a base end of the pressing member is upwardly inserted in the attachment part of the movable body and a portion from a middle to an end of the pressing member is pressed against a top face of the sheet members.

7. The sheet member container according to claim 6, wherein a front wall near the slot of said container body has an inclined face for lifting up a tip of the fed sheet member, and an upper edge of said slot is positioned more to a housing side than the tip of the sheet member fed to reach a lower edge of the slot.

8. The sheet member container according to claim 6, wherein said plurality of projections have at least more than one height.

* * * * *